US012024953B2

(12) United States Patent
Clyburn et al.

(10) Patent No.: US 12,024,953 B2
(45) Date of Patent: Jul. 2, 2024

(54) MODULAR SKID-BASED SYSTEM AND METHOD TO PROVIDE TREATMENT OR COMPLETION OPERATIONS AT A WELL

(71) Applicant: Halliburton Energy Services, Inc., Houston, TX (US)

(72) Inventors: Andrew Silas Clyburn, Duncan, OK (US); Christopher C Poage, Duncan, OK (US); Jim Basuki Surjaatmadja, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 43 days.

(21) Appl. No.: 17/875,092

(22) Filed: Jul. 27, 2022

(65) Prior Publication Data

US 2024/0035342 A1 Feb. 1, 2024

(51) Int. Cl.
*E21B 15/00* (2006.01)
*E21B 43/26* (2006.01)

(52) U.S. Cl.
CPC ..... *E21B 15/003* (2013.01); *E21B 43/2607* (2020.05)

(58) Field of Classification Search
CPC ..... E21B 15/003; E21B 43/2607
See application file for complete search history.

(56) References Cited

U.S. PATENT DOCUMENTS 4,158,510 A 6/1979 Smith et al.
9,140,110 B2 * 9/2015 Coli ..... B01F 23/43
10,815,978 B2 * 10/2020 Glass ..... F04B 15/02
11,015,423 B1 * 5/2021 Yeung ..... E21B 41/005
11,085,281 B1 * 8/2021 Yeung ..... E21B 41/005
11,111,768 B1 * 9/2021 Yeung ..... E21B 43/2607
11,459,863 B2 * 10/2022 Robinson ..... E21B 43/127
2012/0085541 A1 4/2012 Love et al.
2014/0138079 A1 5/2014 Broussard et al.
2014/0174717 A1 6/2014 Broussard et al.
2015/0211524 A1 7/2015 Broussard et al.
2015/0252661 A1 9/2015 Glass
2016/0376864 A1 12/2016 Roesher et al.
2017/0074074 A1 3/2017 Joseph et al.
2018/0073672 A1 3/2018 Varner et al.
2018/0328157 A1 * 11/2018 Bishop ..... F04B 17/06
2019/0120134 A1 * 4/2019 Goleczka ..... F02B 63/044
2020/0208565 A1 * 7/2020 Morris ..... F04B 53/08
2022/0381126 A1 * 12/2022 Cui ..... F04B 17/03

* cited by examiner

*Primary Examiner* — Taras P Bemko
(74) *Attorney, Agent, or Firm* — Barnes & Thornburg LLP

(57) ABSTRACT

A modular skid-based system to provide treatment or competition operations at a well includes a main skid configured to be positioned on a trailer or ground in proximity to the well. A first modular skid is positioned on the main skid and includes a first primary system and a first support system. A second modular skid is positioned on the main skid and includes a second primary system and a second support system. At least one of the second primary system and the second support system is coupled to at least one of the first primary system and the first support system. The first modular skid, the first primary system and the first support system are removable as a whole from the main skid without removing the second modular skid, the second primary system or the second support system.

21 Claims, 9 Drawing Sheets

MODULAR SKID-BASED SYSTEM AND METHOD TO PROVIDE TREATMENT OR COMPLETION OPERATIONS AT A WELL

BACKGROUND

In hydrocarbon wells, the process of treating a well such as by hydraulic fracturing, or even the process of completing a well following drilling, requires extensive equipment placed at or near the surface of the well. This equipment is typically heavy, very large, and often involves numerous fluid connections, electrical connections, mechanical connections and support equipment. Fracturing equipment such as engines, transmissions, pumps and auxiliary equipment is typically mounted on a single trailer in a way that prevents easy or quick replacement of a single piece of equipment without removing other equipment that may not need to be replaced.

The demands on equipment are great. In the case of hydraulic fracturing, operations may take place 24 hours per day, seven days a week. It is extremely costly, both in terms of labor and the lapse in treatment operations when fracturing must be suspended so a single item of equipment, such as a transmission, must be replaced. Because of these costs, the solution is often to provide "spare" fracturing trailers with a replacement set of all required equipment to minimize downtime. Each of these spare trailers, including engine, transmission, and pump, and the interconnected and often shared support systems, can cost at least $1.5 MM. While substituting a replacement trailer when a particular item of equipment fails reduces system downtime, the costs of maintaining full, spare trailers on site is extremely costly.

DETAILED DESCRIPTION

In the following detailed description of several illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston or other means of converting applied flow or pressure to mechanical or fluid force.

The present disclosure relates to systems and methods for providing treatment or completion operations at a well that accesses a subterranean hydrocarbon formation. As described in more detail below, the system allows for quick and cost effective replacement of components that are used to provide treatment to the well, or alternatively during completion operations such as cementing that are performed after the well is drilled.

Figure 1:
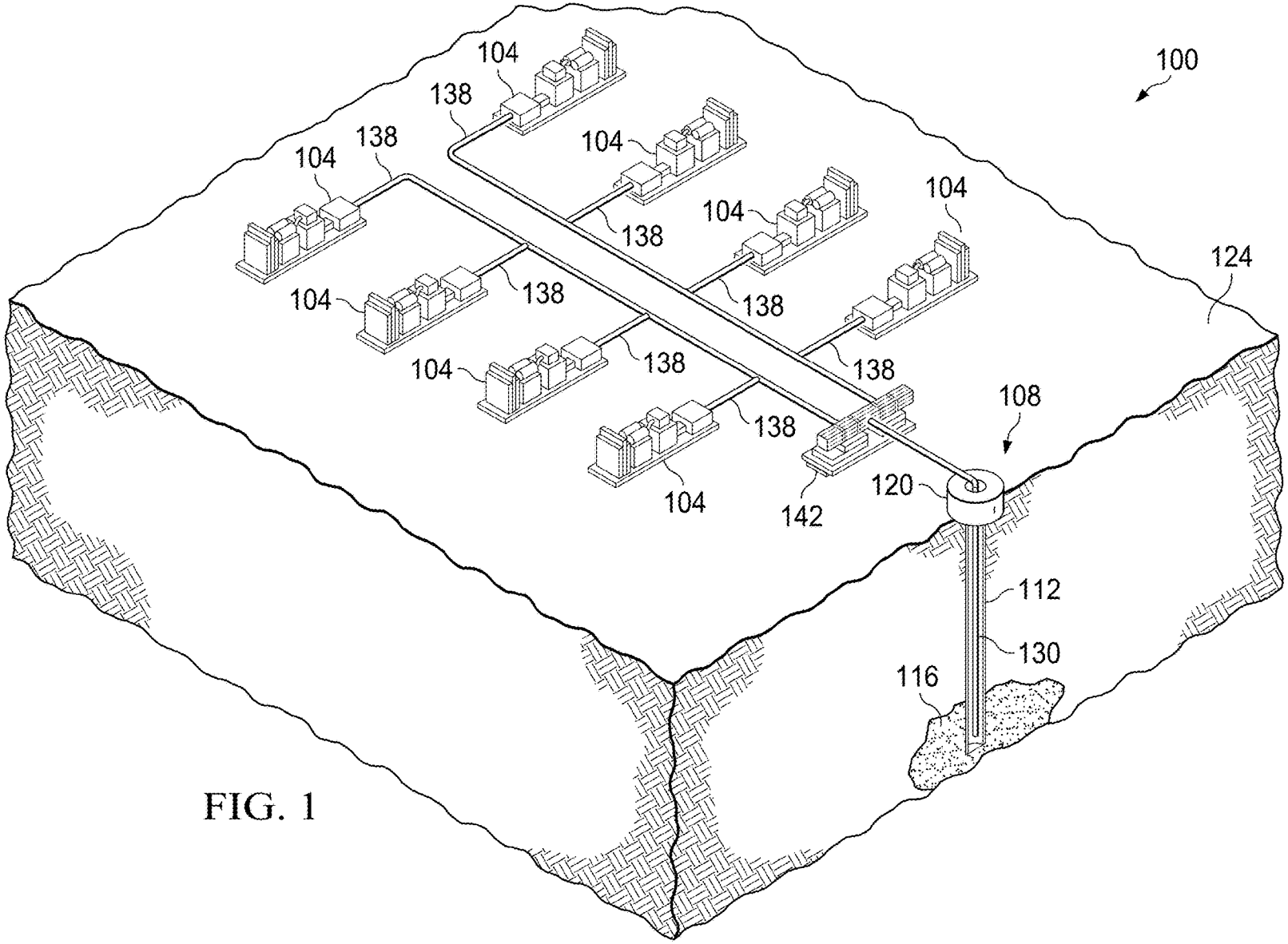
FIG. 1 illustrates a schematic view of a multi-skid, modular skid-based system according to an illustrative embodiment.

FIG. 1 shows a schematic of a multi-skid, modular skid-based system 100 according to an illustrative embodiment. The multi-skid, modular skid-based system 100 includes a plurality of main skids 104 positioned at a well site 108 that includes a well 112 accessing a hydrocarbon formation 116. A wellhead 120 is positioned at a surface 124 of the well 112 to provide the structural and pressure-containing interface with the wellbore. At least one tubing string 130 may be disposed in the well 112 to allow fluid communication with the formation through the wellhead 120.

Each of the main skids 104 of the multi-skid, modular skid-based system 100 include equipment (described in more detail herein) that is used to either treat the formation 116 or perform completion operations on the well 112. In one embodiment, the equipment positioned on each main skid 104 may be used to hydraulically fracture the formation 116 and may include components such as engines or motors, transmissions, pumps, and support and control systems. In such an embodiment, the fracturing equipment may be fluidly coupled to the wellhead 120 by a plurality of conduits 138, and in some cases, one or more manifolds 142. Fracturing fluid may be delivered through the conduits 138 and manifold 142, which may be fluidly coupled to the tubing string 130 in the well 112.

In another embodiment, the equipment positioned on each main skid 104 may be used to perform completion operations on the well 112, such as cementing the well to shut off water penetration into a well. Each main skid 104 may include components such as engines or motors, transmissions, cement mixers, pumps, and support and control systems. In such an embodiment, the cementing equipment may be provided on one or more main skids, with at least some of the equipment fluidly coupled to the wellhead 120 by one or more conduits 138.

Figure 2:
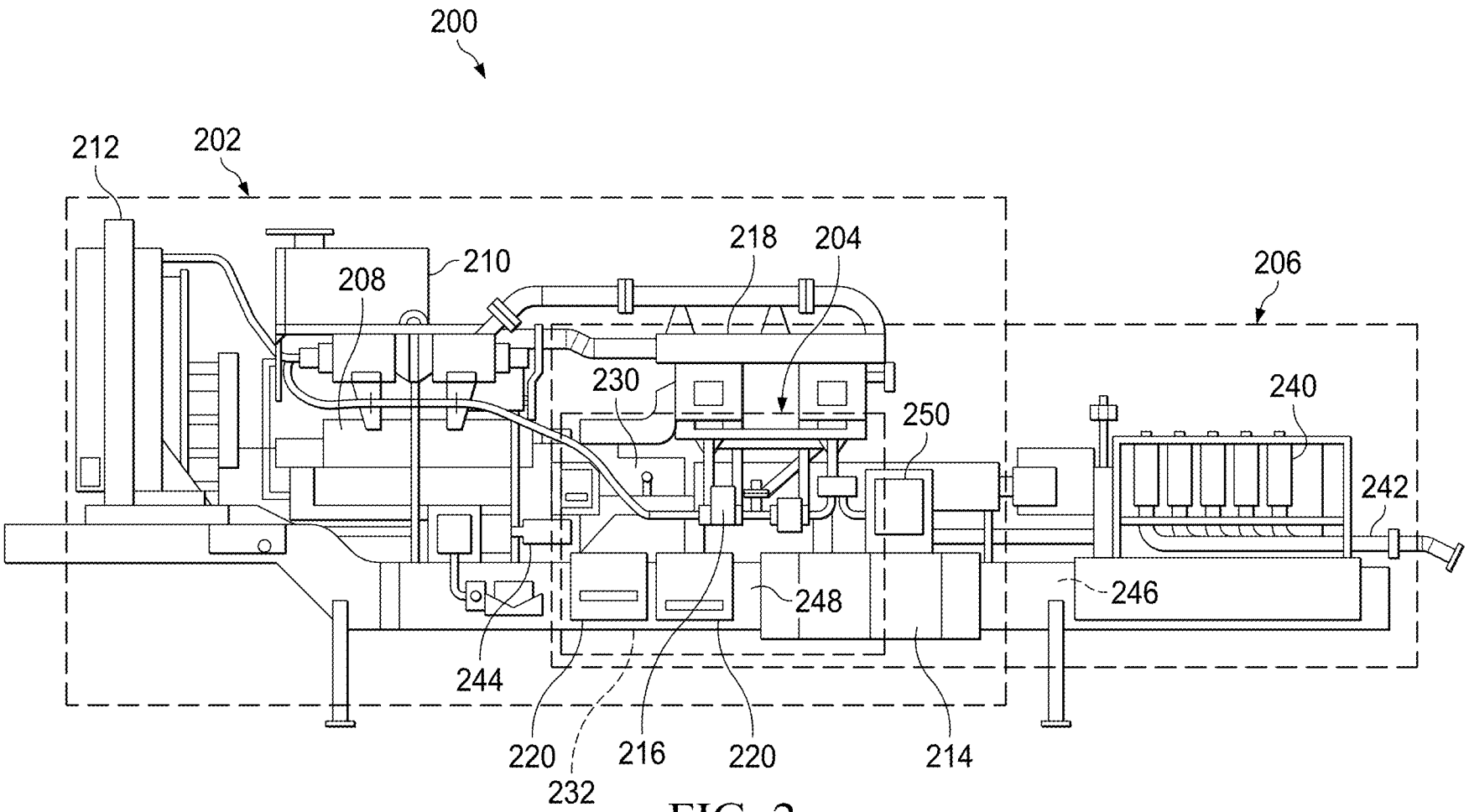
FIG. 2 illustrates a schematic view of a typical trailer-configured fracturing system.

FIG. 2 illustrates a schematic view of a typical trailer-configured fracturing rig or system 200. Fracturing rig 200 is emblematic of current equipment configurations for fracturing operations. Since the equipment is typically very heavy, it is delivered on a trailer pulled by a commercial tractor rig, and the equipment is configured as a unitary system on the trailer. Fracturing rig 200 includes an engine system 202, a transmission system 204, and a pumping system 206. In this traditional arrangement of a fracturing rig, the components of each of these systems are often arranged in a compact manner on the trailer to minimize the space occupied by the components and the weight attributable to the entire rig. Certain of the components may in some circumstances be shared by the systems (e.g., radiators or cooling equipment, lubrication systems, controls, etc.). The engine system 206 includes an engine 208, an exhaust 210, a radiator 212, a liquid fuel supply 214, a gaseous fuel supply 216, an intake cooler 218, and controls 220. The transmission system 204 includes a transmission 230, a transmission cooler and filters 232 (hidden), and controls 220. The pumping system 206 includes a pump 240, pump manifold 242, lube pump 244, lube tank 246 (hidden, but mounted between trailer frame rails), lube cooler and filters 248, pump grease system 250, and controls 220. Drivelines between major equipment, such as the engine, transmission and pump are often buried deeply beneath other equipment, and it is difficult to access without removing many different components. Many times mounts for the equipment are also obstructed for other equipment, which again makes equipment difficult to remove, repair or replace. For example, with fracturing rigs such as that illustrated in FIG. 2, it requires removal of over one hundred bolts or other fasteners to remove the transmission. Other equipment such as heat exchangers, intake systems, fueling systems, piping and mounts must also be loosened or removed before the transmission can be replaced. Such a configuration of equipment is very inefficient when it is time to replace a component, and most operators have decided it is better to keep multiple complete replacement rigs on site so that the fracturing operation is shut down for as little time as possible.

Figure 3:
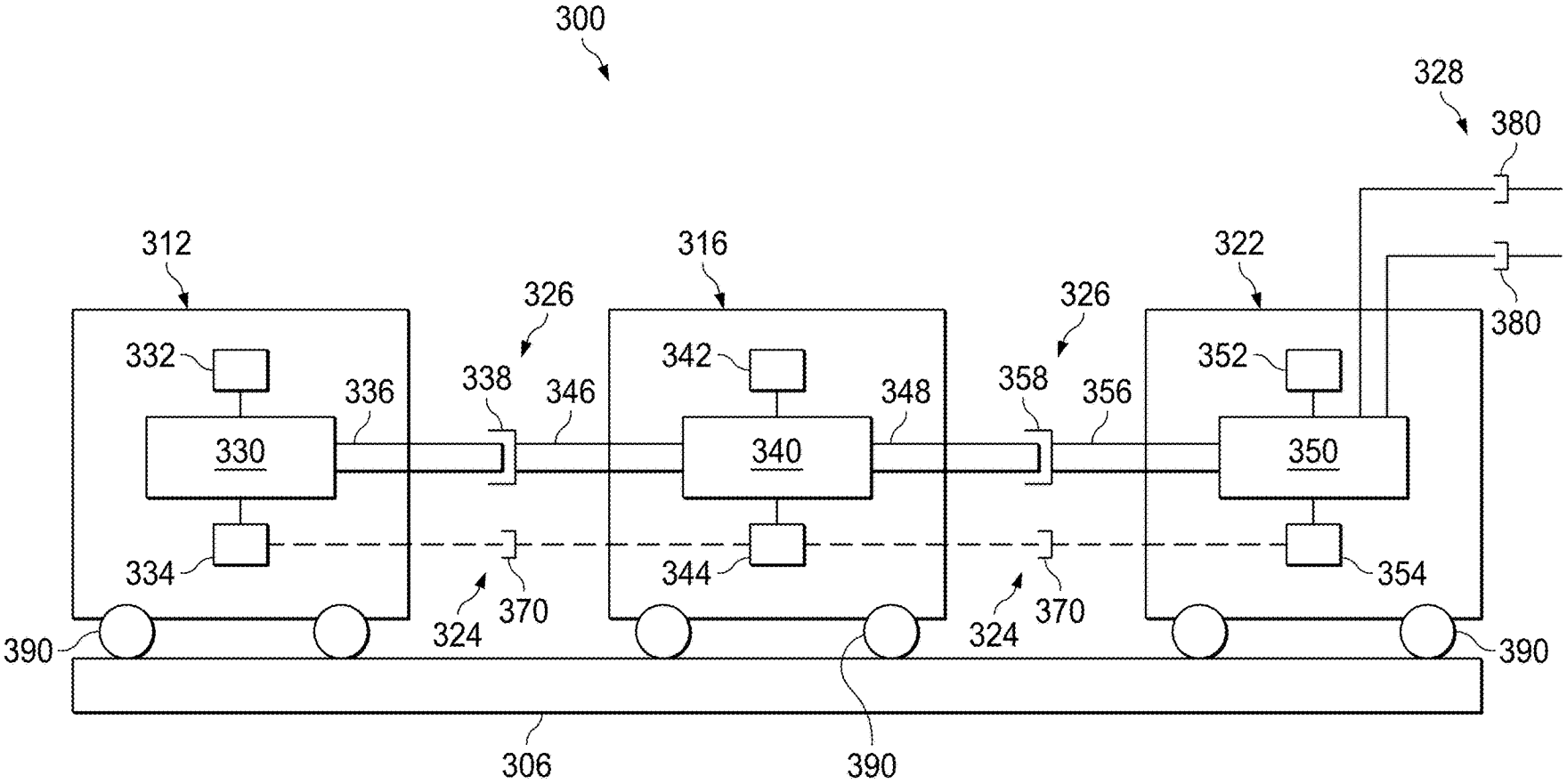
FIG. 3 illustrates a schematic view of a modular skid-based system according to an illustrative embodiment.

FIG. 3 illustrates a schematic view of a modular skid-based system 300 according to an illustrative embodiment. Modular skid-based system 300 provides advantage on the more integrated system design provided in a system such as fracturing rig 200. The modular skid-based system 300 provides for the separation and modularization of equipment and support systems, which permits operators to more easily replace certain equipment in a timely and cost-effective manner. In one embodiment, system 300 includes a main skid 306 configured to be positioned on a trailer or ground in proximity to the well 112. It is important to note that while system 300 may also be transported or installed on a trailer, system 300 is very different from the integrated equipment configuration of the trailer-based fracturing rig 200. Main skid 306 may be positioned directly on a trailer (not shown) for transport to the well site. Once at the well site, the main skid 306 may be removed from the trailer and positioned on the ground. Alternatively, the main skid 306 may be allowed to remain on the trailer for the duration of the treatment or completion operations.

The modular skid-based system 300 includes a first modular skid 312, a second modular skid 316, and a third modular skid 322, each positioned on the main skid 306. The first modular skid 312 may include a first primary system 330 and a plurality of first support systems such as support system 332 and support system 334. The second modular skid 316 may include a second primary system 340 and a plurality of second support systems such as support system 342 and support system 344. The third modular skid 322 may include a third primary system 350 and a plurality of third support systems such as support system 352 and support system 354. Each of the "primary systems" associated with a modular skids represent major equipment for the operation being performed that may in cases of failure need to be replaced. For example, for fracturing operations, the first primary system 330 may be an engine that is used to provide motive energy, ultimately, to a pump that injects fracturing fluid in the well. In the same embodiment, the second primary system 340 may be a transmission that is used to provide speed reduction between the engine and the pump. The third primary system 350 may be the pump, which could be any type of pump, but for fracturing operations is often a positive-displacement pump.

Each primary system in one embodiment includes all of the support systems that are necessary for the functioning of the primary system, thereby reducing the number of connections between adjacent modular skids and making swaps of the skids less challenging. Examples of support systems 332, 334, 342, 344, 352, 354 may include cooling systems, lubrication systems, control units, or any other system that may be used with a particular primary system.

Connections to or between the modular skids 312, 316, 322 may include electrical connections 324, mechanical connections 326, and fluid connections 328. In a fracturing embodiment, the first primary system 330 (e.g., engine) disposed on the first modular skid 312 may be mechanically connected by a shaft 336 to a shaft 346 associated with the second primary system 340 (e.g., transmission) on the second modular skid 316. A coupling 338 may be used to quickly and releasably couple the shaft 336 to the shaft 346. Similarly, the second primary system 340 (e.g., transmission) disposed on the second modular skid 316 may be mechanically connected by a shaft 348 to a shaft 356 associated with the third primary system 350 (e.g., pump) on the third modular skid 322. A coupling 358 may be used to quickly and releasably couple the shaft 348 to the shaft 356. When mechanically coupled, the shafts 336, 346, 348, 356 are a driveline that is capable of transferring power from the engine to the transmission to the pump.

Figure 4:
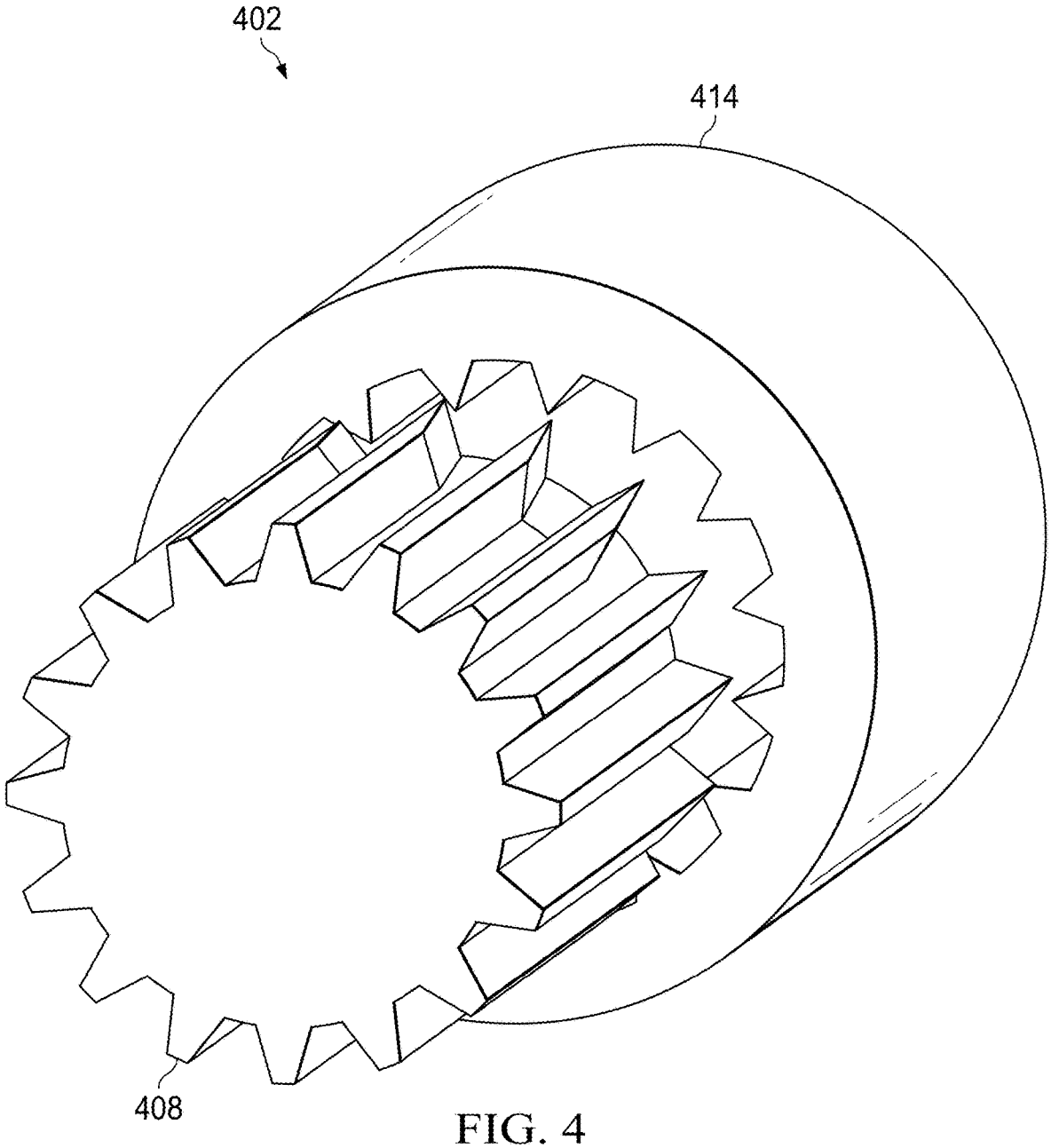
FIG. 4 illustrates a mechanical coupling having a spline and collar for use with a modular skid-based system according to an illustrative embodiment.

FIG. 4 illustrates a mechanical coupling 402 having a spline 408 and collar 414. The spline 408 and collar 414 have complimentary teeth that engage one another to transfer power. When used as a coupling for the modular skid-based systems described herein, the spline 408 may be coupled to or integrally formed on shafts (e.g., 336, 346, 348, 356) that extend from the modular skids (e.g., 312, 316, 322). The collar 414 may be coupled to or a part of the couplings (e.g., 338, 358) that are used to quickly attach or detach adjacent shafts. As an alternative to a spline/collar arrangement, any mechanical coupling may be used, including without limitations torsional, ridged, flanged, pinned, sleeved, jawed, lugged, magnetic, or self-aligned, tapered couplings.

Referring again to FIG. 3, the electrical connections 324 between adjacent modular skids 312, 316, 322 may be used to connect support system 334 to support system 344 to support system 354. In the fracturing example, the support systems 334, 344, 354 may each be control units associated with each modular skids 312, 316, 322 to allow control of the transmission and engine in order to vary the flow rate or pressure of fluid discharged by the pump. Each of the electrical connections 324 includes an electrical coupling 370 which allows a particular modular skid and its associated equipment to be quickly and easily disconnected from adjacent modular skids.

The fluid connections 328 represent intake and discharge conduits that are connected to the pump in the fracturing example. The fluid connection 328 provide fluid to the well 112 and allow low pressure fluid to be supplied to the pump. Each of the fluid connections 328 includes a fluid coupling 380 which allows a particular modular skid to be quickly and easily disconnected from any fluid lines.

Each of the modular skids 312, 316, 322 may include a plurality of wheels 390 that allow the modular skids to be more easily moved in relation to one another along the main skid 306 when desired. When a failure occurs in a primary system or support system on one of the modular skids, that module skid may be easily disconnected from any adjacent skid or connections using the quick disconnect couplings described herein. The modular skids may be moved along the main skid 306 during the disconnection process as needed. After removing the modular skid that had a failure, a replacement modular skid may be substituted and quickly connected to adjacent modular skids or connections. During or after the process of restoring the connections, the modular skids may be re-secured to the main skid 306 to relative movement along the main skid 306.

Figure 5:
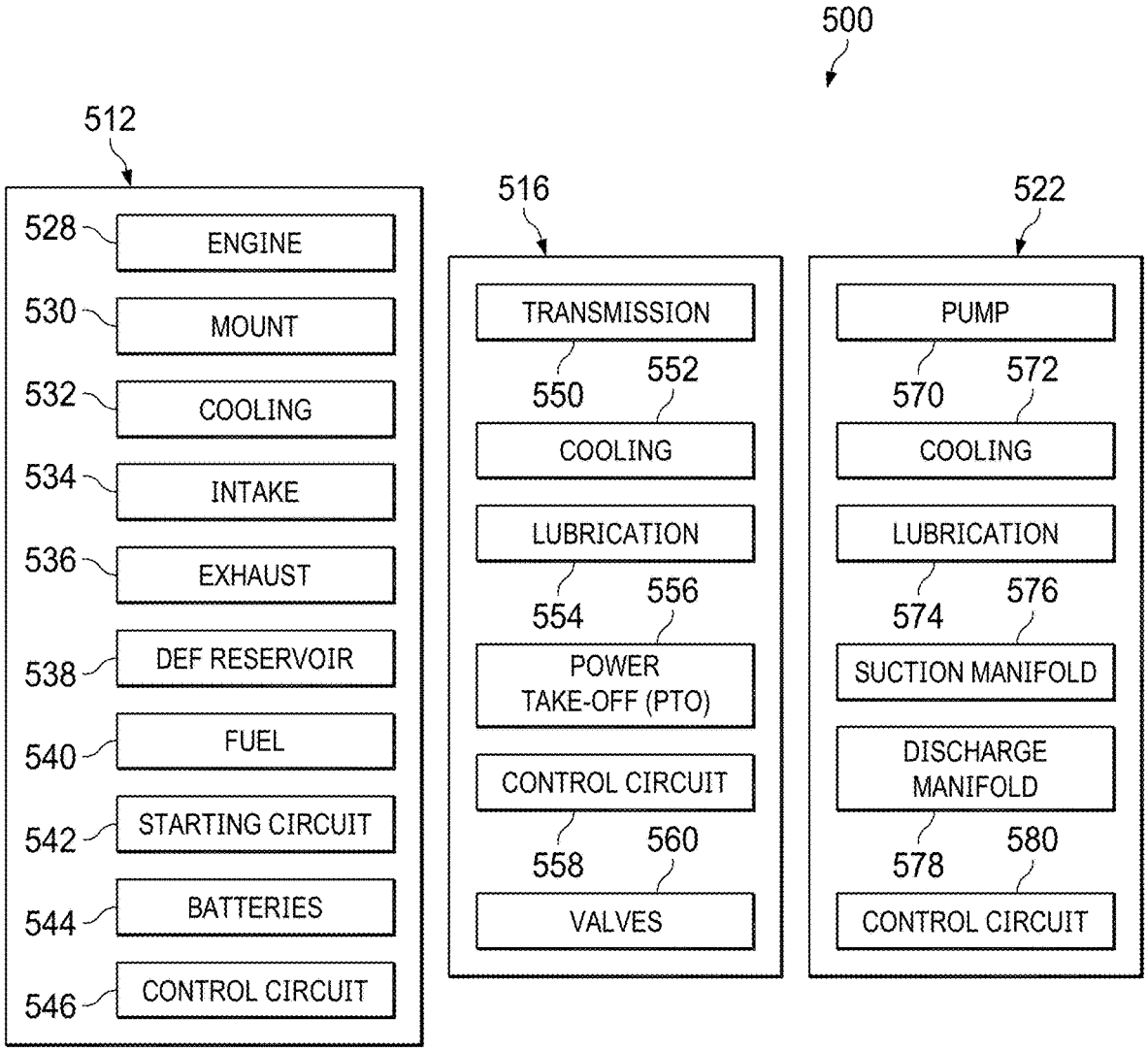
FIG. 5 illustrates a schematic view of a plurality of skids or modules from a modular skid-based system according to an illustrative embodiment.

FIG. 5 illustrates a schematic view of a plurality of modular skids 512, 516, 522 or modules from a modular skid-based system 500 according to an illustrative embodiment. The modular skids 512, 516, 522 may be similar to the modular skids described with reference to modular skid-based systems 100, 300. Modular skid 512 is a mover module and may include a primary system that includes an engine 528. The engine 528 may be a gasoline, diesel, hydrogen, natural gas or other hydrocarbon or non-hydrocarbon-driven engine. In some embodiments, the engine may operate on a combination or two or more fuel types. Alternatively, the engine could be an electrical motor. Support systems of mover module 512 include components and equipment that support the operation of the engine and that allow the mover module (including the engine) to be easily and quickly replaced in the event of failure. Some of the support systems include an engine mount 530, a cooling system 532, an intake 534, an exhaust 536, a diesel exhaust fluid (DEF) reservoir and system 538, fuel system 540, a starting circuit 542, one or more batteries 544, and a control circuit 546.

Modular skid 516 is a speed reduction module and may include a primary system that includes a transmission 550. Alternatively, the transmission could be a gear box connected to a shaft or fluid power system such as hydraulics. Support systems of speed reduction module 516 include components and equipment that support the operation of the transmission and that allow the speed reduction module (including the transmission) to be easily and quickly replaced in the event of failure. Some of the support systems include a cooling system 552, a lubrication reservoir and system 554, a power take-off (PTO) 556, a control circuit 558, and one or more valves 560.

Modular skid 522 is a pump module and may include a primary system that includes a fracturing pump 570. Support systems of pump module 522 include components and equipment that support the operation of the fracturing pump and that allow the pump module (including the fracturing pump) to be easily and quickly replaced in the event of failure. Some of the support systems include a cooling system 572, a lubrication reservoir and system 574, a suction manifold 576, a discharge manifold 578, and a control circuit 580.

Figure 6:
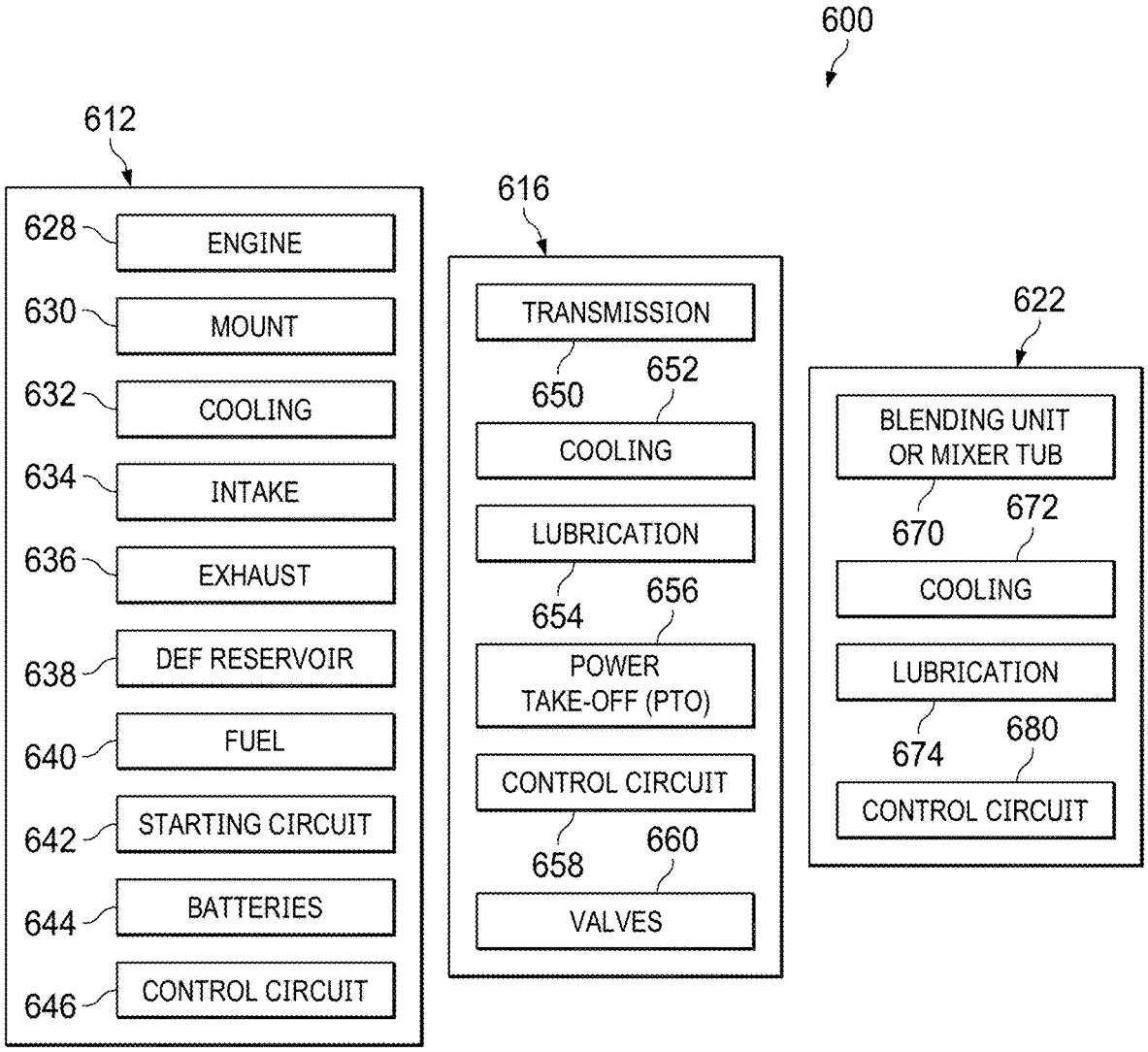
FIG. 6 illustrates a schematic view of a plurality of skids or modules from a modular skid-based system according to an illustrative embodiment.

FIG. 6 illustrates a schematic view of a plurality of skids 612, 616, 622 or modules from a modular skid-based system 600 according to an illustrative embodiment. The modular skids 612, 616, 622 may be similar to the modular skids described with reference to modular skid-based systems 100, 300, and 500. In the example shown in FIG. 6, the system 600 is used in completion operations such as cementing, but the system 600 may also be used in treatment operations such as for mixing or blending fracturing fluids. Modular skid 612 is a mover module and may include a primary system that includes an engine 628. The engine 628 may be a gasoline, diesel, hydrogen, natural gas or other hydrocarbon or non-hydrocarbon-driven engine. In some embodiments, the engine may operate on a combination or two or more fuel types. Alternatively, the engine could be an electrical motor. Support systems of mover module 612 include components and equipment that support the operation of the engine and that allow the mover module (including the engine) to be easily and quickly replaced in the event of failure. Some of the support systems include an engine mount 630, a cooling system 632, an intake 634, an exhaust 636, a diesel exhaust fluid (DEF) reservoir and system 638, fuel system 640, a starting circuit 642, one or more batteries 644, and a control circuit 646.

Modular skid 616 is a speed reduction module and may include a primary system that includes a transmission 650. Alternatively, the transmission could be a gear box connected to a shaft or fluid power system such as hydraulics. Support systems of speed reduction module 616 include components and equipment that support the operation of the transmission and that allow the speed reduction module (including the transmission) to be easily and quickly replaced in the event of failure. Some of the support systems include a cooling system 652, a lubrication reservoir and system 654, a power take-off (PTO) 656, a control circuit 658, and one or more valves 660.

Modular skid 622 is a mixer or blending module and may include a primary system that includes a mixer or a blender 670. Support systems of module 622 include components and equipment that support the operation of the mixer/blender and that allow the mixer/blender module (including the mixer/blender) to be easily and quickly replaced in the event of failure. Some of the support systems include a cooling system 672, a lubrication reservoir and system 674, and a control circuit 676.

Figure 7:
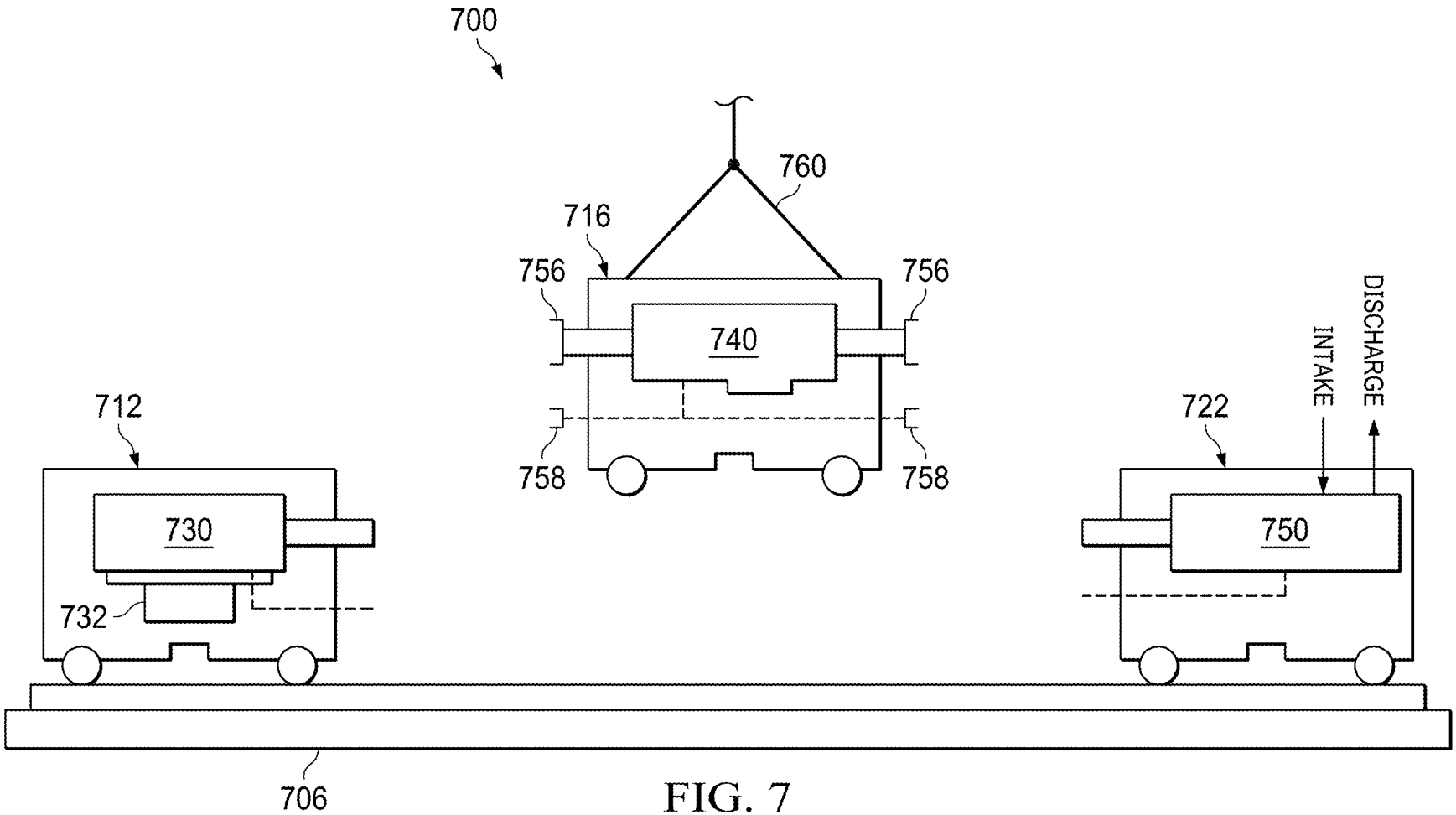
FIG. 7 illustrates a schematic view of a modular, skid-based fracturing system according to an illustrative embodiment, the system being shown with a speed-reduction module being removed from the system.

FIG. 7 illustrates a schematic view of a modular, skid-based fracturing system 700 according to an illustrative embodiment. Similar to systems 300 and 500, the skid-based fracturing system includes a mover module 712, a speed-reduction module 716, and a pump module 722 all positioned on a main skid 706. The mover module 712 includes an engine 730 and an engine mount 732. The speed-reduction module 716 includes a transmission 740, and the pump module 722 includes a fracturing pump 750. For simplicity, some of the support systems in each module are not separately shown. In the embodiment illustrated in FIG. 7, the transmission has failed and thus the speed-reduction module 716 has been disconnected from the mover module 712 and the pump module 722. More specifically, mechanical couplings 756 and electrical couplings 758 have been disconnected between the modules. The modules have also been separated and the speed-reduction module 716 is being lifted by a harness 760 that may be attached to a winch or crane (not shown). Following removal of the failed speed-reduction module, a backup speed-reduction module with a working transmission may be lowered into place on the main skin and the modules reconnected.

Figure 8:
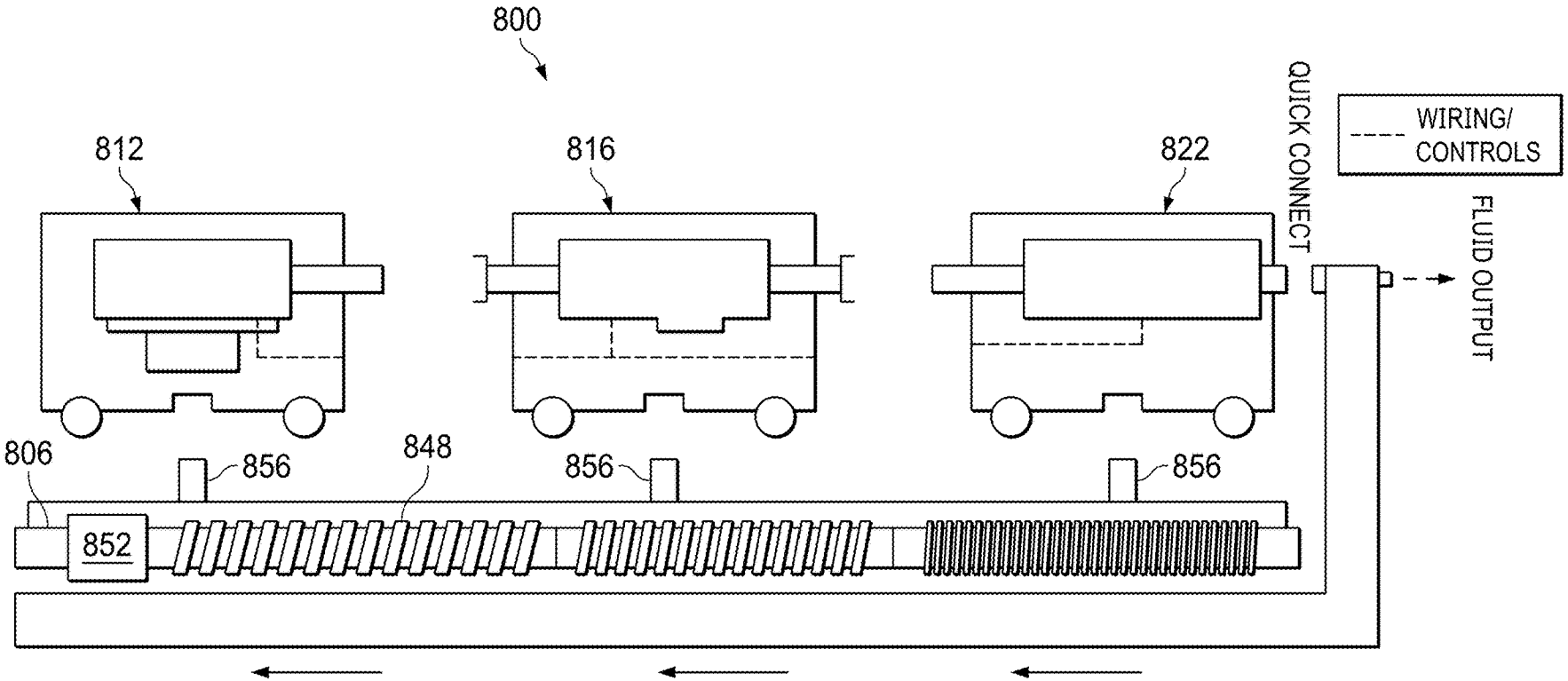
FIG. 8 illustrates a schematic view of a modular, skid-based fracturing system according to an illustrative embodiment, the system being shown with a threaded conveyor for moving modules of the skid-based fracturing system.

FIG. 8 illustrates a schematic view of a modular, skid-based fracturing system 800 according to an illustrative embodiment. Similar to systems 300, 500 and 700, the skid-based fracturing system includes a mover module 812, a speed-reduction module 816, and a pump module 822 all positioned on a main skid 806. Each of the modular skids or "modules" includes equipment similar to that described herein with respect to other systems and is configured with easily connectable and disconnectable couplings between modules. The system 800 further includes a threaded conveyor 848 for moving modules of the skid-based fracturing system along the main skid 806. The threaded conveyor 848 may be a threaded shaft that is rotatably coupled to or beneath the main skid 806. A motor and controller 852 may be operably coupled to the threaded conveyor 848 to turn the conveyor relative to the main skid 806. A plurality of guides 856, which preferably includes at least one for each module, is configured to engage the threads of the threaded conveyor 848. As the threaded conveyor 848 is rotated, the guides 856 move in a first direction or a second direction along the main skid 806 depending on the direction of rotation. The guides 856 each engage a complimentary slot 862 on each module such that motion of the guides also moves the modules. In one embodiment, the number of threads per length along the threaded conveyor 848 varies for each of the modules. Such a variation allows the guides to move a greater distance for the coarser threads (few threads per length) relative to the guides that are influenced by the finer threads (more threads per length). The threaded conveyor 848 with portions have different thread characteristics allows the movement of the modules to be closely controlled and simplifies the connection of adjacent modules since two modules may first be connected and then the third.

Figure 9:
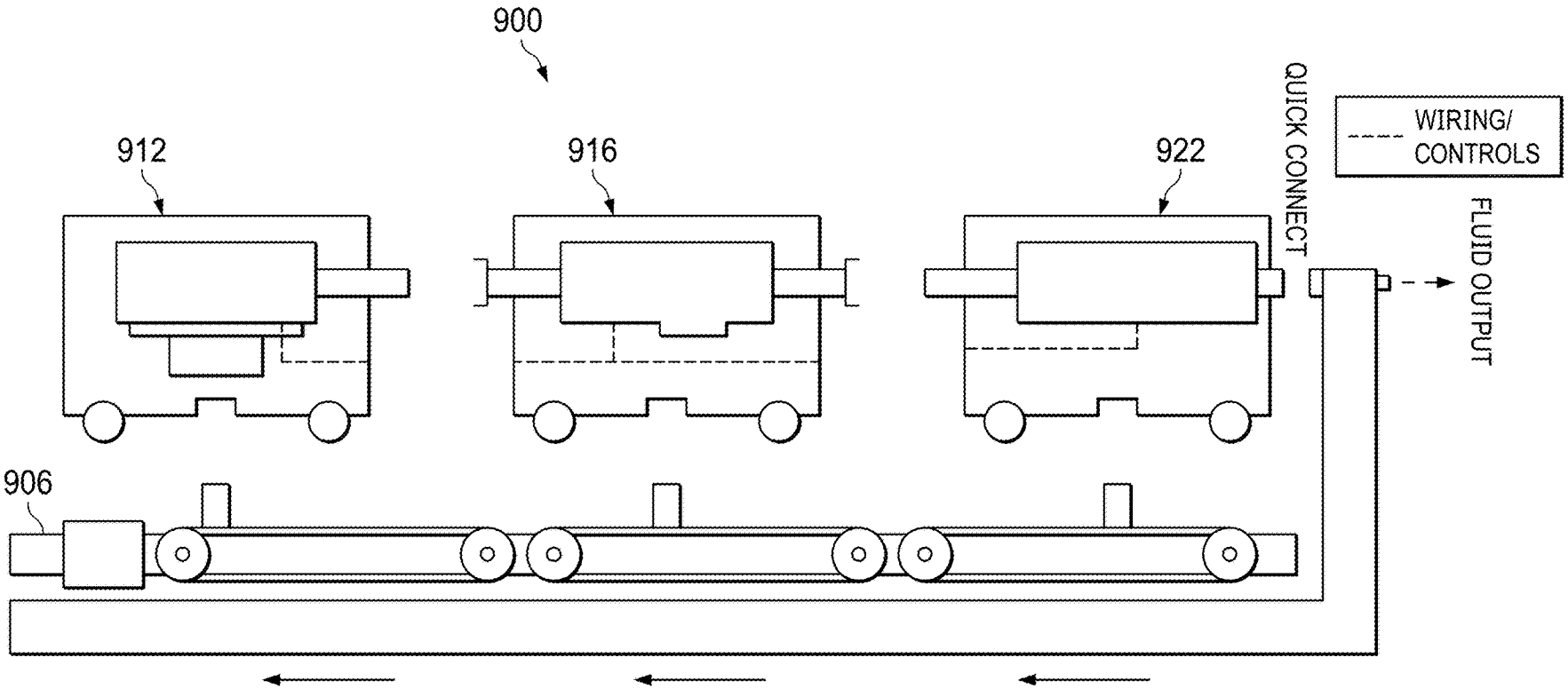
FIG. 9 illustrates a schematic view of a modular, skid-based fracturing system according to an illustrative embodiment, the system being shown with a winch for moving modules of the skid-based fracturing system.

FIG. 9 illustrates a schematic view of a modular, skid-based fracturing system 900 according to an illustrative embodiment. Similar to systems 300, 500, 700, and 800, the skid-based fracturing system includes a mover module 912, a speed-reduction module 916, and a pump module 922 all positioned on a main skid 906. Each of the modular skids or "modules" includes equipment similar to that described herein with respect to other systems and is configured with easily connectable and disconnectable couplings between modules. Instead of the threaded conveyor 848 of system 800, the system 900 includes a winch and pulley system to move the modules along the main skid 906 when a replacement is needed. Alternatively, the modules may be moved by any other type of mechanical, electrical, or fluid-powered conveyor or movement system. In an embodiment, movement of the modules may be performed by one or more hydraulically-operated cylinders. In other embodiments, the modules or skids may just be dropped in place and a shaft or coupling may be used to connect adjacent modules or skids without moving them from the location the skids or modules were originally dropped. Any sufficient coupling may be used, but one example may include the splined coupling shown in FIG. 4.

It should be understood that while the modular skid-based systems described herein have been described as having two or three modular skids or modules in the illustrated embodiments, additional modules could be provided depending on the operation that is being performed.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure.

Clause 1, a modular skid-based system to provide treatment or completion operations at a well, the system comprising a main skid configured to be positioned on a trailer or ground in proximity to the well; a first modular skid positioned on the main skid, the first modular skid having a first primary system and a first support system; a second modular skid positioned on the main skid, the second modular skid having a second primary system and a second support system, at least one of the second primary system and the second support system coupled to at least one of the first primary system and the first support system; wherein the first modular skid, the first primary system and the first support system are removable as a whole from the main skid without removing the second modular skid, the second primary system or the second support system.

Clause 2, the system of clause 1, wherein the first primary system is an engine and the first support system is a first cooling system, the first cooling system operably connected to the engine to provide cooling to the engine.

Clause 3, the system of clause 1, wherein the second primary system is a pump and the second support system is a second cooling system or a lube system to provide cooling or lubrication to the pump.

Clause 4, the system of clause 1, wherein the first primary system is an engine; the first support system is a first cooling system to provide cooling to the engine; the second primary system is a pump; and the second support system is a second cooling system or a lube system to provide cooling or lubrication to the pump.

Clause 5, the system of clause 4, wherein the engine is mechanically coupled to the pump.

Clause 6, the system of clause 1 further comprising a conveyor system coupled to the main skid and configured to move the first modular skid relative to the second modular skid.

Clause 7, the system of clause 1 wherein the conveyor system is at least one of a threaded conveyor system, a belt-driven conveyor system, or a winch and pulley.

Clause 8, the system of clause 1, wherein the first primary system is an engine; the first support system is a first cooling system to provide cooling to the engine; the second primary system is a mixer or blender; and the second support system is a second cooling system or a lube system to provide cooling or lubrication to the mixer or blender.

Clause 9, a modular skid-based system to provide hydraulic fracturing treatment at a well, the system comprising a main skid configured to be positioned on a trailer or ground in proximity to the well; a mover module positioned on the main skid, the mover module having an engine and a first cooling system coupled to the engine to provide cooling; a speed reduction module positioned on the main skid, the speed reduction module having a transmission or gear box and a second cooling system, the second cooling system coupled to the transmission or gear box to provide cooling; a pump module positioned on the main skid, the pump module having a fracturing pump to provide pressurized fracturing fluid to the well, the pump module further having at least one of a lubrication system and a cooling system to provide lubrication or cooling to the pump; a first mechanical coupling and a first control coupling to couple the mover module to the speed reduction module; and a second mechanical coupling and a second control coupling to couple the speed reduction module to the pump module; wherein the mover module, the speed reduction module and the pump module are each independently removable from the main skid without removing any of the other modules.

Clause 10, the system of clause 9, wherein the first mechanical coupling and the second mechanical coupling are spline and collar couplings.

Clause 11, the system of clause 9, wherein the mover module further includes an engine mount.

Clause 12, the system of clause 9 further comprising a conveyor system coupled to the main skid and configured to move at least one of the mover module, the speed-reduction module and the pump module along the main skid.

Clause 13, the system of clause 12 wherein the conveyor system is a threaded conveyor system, a belt-driven conveyor system, or a winch and pully.

Clause 14, the system of clause 12 wherein the conveyor system is a threaded conveyor system having a threaded shaft, the threaded shaft having a first threaded portion with first threads and a second threaded portion with second threads; and the first threads having a greater number of threads per length that the second threads.

Clause 15, method of treating or completing a subterranean well comprising providing a first modular skid having a first primary system and a first support system; providing a second modular skid having a second primary system and a second support system, at least one of the second primary system and the second support system coupled to at least one of the first primary system and the first support system; providing a third modular skid having a third primary system and a third support system, at least one of the third primary system and the third support system coupled to at least one of the second primary system and the second support system; removing the second modular skid from a main skid on which the first modular skid, the second modular skid, and the third modular skid are positioned without removing the first and second modular skids; replacing the second modular skid with a backup second modular skid having a backup second primary system and a backup second support system; coupling at least one of the first primary system and the first support system to at least one of the backup second primary system and the backup second support system; and coupling at least one of the third primary system and the third support system to at least one of the backup second primary system and the backup second support system.

Clause 16, the method of clause 15, wherein the first primary system is an engine; the first support system is a first cooling system to provide cooling to the engine; the second primary system is a transmission or gear box; the second support system is a second cooling system; the third primary system is a pump; and the third support system is a third cooling system or a lube system to provide cooling or lubrication to the pump.

Clause 17, the method of clause 16, wherein the coupling of the at least one of the first primary system and the first support system to the at least one of the backup second primary system and the backup second support system further comprises mechanically coupling the engine to the transmission or gear box; and the coupling of the at least one of the third primary system and the third support system to the at least one of the backup second primary system and the backup second support system further comprises mechanically coupling the pump to the transmission or gear box.

Clause 18, the method of clause 15 further comprising prior to removing the second modular skid from the main skid, disconnecting the at least one of the second primary system and the second support system from the at least one of the first primary system and the first support system; prior to removing the second modular skid from the main skid, disconnecting the at least one of the third primary system and the third support system from the at least one of the second primary system and the second support system; conveying at least one of the first modular skid, the second modular skid, and the third modular skid on the main skid using a conveyor system.

Clause 19, the method of clause 18, wherein conveying further comprises rotating a threaded conveyor to move the first modular skid, the second modular skid, or the third modular skid.

Clause 20, the method of clause 12, wherein conveying further comprises operating a winch to move the first modular skid, the second modular skid, or the third modular skid.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

We claim:

1. A modular skid-based system to provide treatment or completion operations at a well, the system comprising:

a main skid configured to be positioned on a trailer or ground in proximity to the well;

a first modular skid positioned on the main skid, the first modular skid having a first primary system and a first support system;

a second modular skid positioned on the main skid, the second modular skid having a second primary system and a second support system, at least one of the second primary system and the second support system coupled to at least one of the first primary system and the first support system;

wherein the first modular skid, the first primary system and the first support system are removable as a whole from the main skid without removing the second modular skid, the second primary system or the second support system;

wherein the first primary system is an engine;

wherein the first support system is a first cooling system to provide cooling to the engine;

wherein the second primary system is a mixer or blender; and wherein the second support system is a second cooling system or a lube system to provide cooling or lubrication to the mixer or blender.

2. The system of claim 1, wherein the engine is mechanically coupled to the mixer or blender.

3. The system of claim 1 further comprising:

a conveyor system coupled to the main skid and configured to move the first modular skid relative to the second modular skid.

4. The system of claim 3 wherein the conveyor system is at least one of a threaded conveyor system, a belt-driven conveyor system, a winch and pulley, or a hydraulically-operated cylinder.

5. A modular skid-based system to provide hydraulic fracturing treatment at a well, the system comprising:

a main skid configured to be positioned on a trailer or ground in proximity to the well;

a mover module positioned on the main skid, the mover module having an engine and a first cooling system coupled to the engine to provide cooling;

a speed reduction module positioned on the main skid, the speed reduction module having a transmission or gear box and a second cooling system, the second cooling system coupled to the transmission or gear box to provide cooling;

a pump module positioned on the main skid, the pump module having a fracturing pump to provide pressurized fracturing fluid to the well, the pump module further having at least one of a lubrication system and a cooling system to provide lubrication or cooling to the pump;

a first mechanical coupling and a first control coupling to couple the mover module to the speed reduction module;

a second mechanical coupling and a second control coupling to couple the speed reduction module to the pump module; and a conveyor system coupled to the main skid and configured to move at least one of the mover module, the speed-reduction module and the pump module along the main skid;

wherein the mover module, the speed reduction module and the pump module are each independently removable from the main skid without removing any of the other modules;

wherein the conveyor system is a threaded conveyor system having a threaded shaft, the threaded shaft having a first threaded portion with first threads and a second threaded portion with second threads;

wherein the first threads have a greater number of threads per length than the second threads.

6. The system of claim 5, wherein the first mechanical coupling and the second mechanical coupling are spline and collar couplings.

7. The system of claim 5, wherein the mover module further includes an engine mount.

8. A method of treating or completing a subterranean well comprising:

providing a first modular skid having a first primary system and a first support system;

providing a second modular skid having a second primary system and a second support system, at least one of the second primary system and the second support system coupled to at least one of the first primary system and the first support system;

providing a third modular skid having a third primary system and a third support system, at least one of the third primary system and the third support system coupled to at least one of the second primary system and the second support system;

removing the second modular skid from a main skid on which the first modular skid, the second modular skid, and the third modular skid are positioned without removing the first and third modular skids;

replacing the second modular skid with a backup second modular skid having a backup second primary system and a backup second support system;

coupling at least one of the first primary system and the first support system to at least one of the backup second primary system and the backup second support system; and coupling at least one of the third primary system and the third support system to at least one of the backup second primary system and the backup second support system;

conveying at least one of the first modular skid, the second modular skid, and the third modular skid on the main skid using a conveyor system;

wherein conveying further comprises rotating a threaded conveyor to move the first modular skid, the second modular skid, or the third modular skid.

9. The method of claim 8, wherein:

the first primary system is an engine;

the first support system is a first cooling system to provide cooling to the engine;

the second primary system is a transmission or gear box;

the second support system is a second cooling system;

the third primary system is a pump; and the third support system is a third cooling system or a lube system to provide cooling or lubrication to the pump.

10. The method of claim 9, wherein:

the coupling of the at least one of the first primary system and the first support system to the at least one of the backup second primary system and the backup second support system further comprises mechanically coupling the engine to the transmission or gear box; and the coupling of the at least one of the third primary system and the third support system to the at least one of the backup second primary system and the backup second support system further comprises mechanically coupling the pump to the transmission or gear box.

11. A modular skid-based system to provide treatment or completion operations at a well, the system comprising:

a main skid configured to be positioned on a trailer or ground in proximity to the well;

a first modular skid positioned on the main skid, the first modular skid having a first primary system and a first support system;

a second modular skid positioned on the main skid, the second modular skid having a second primary system and a second support system, at least one of the second primary system and the second support system coupled to at least one of the first primary system and the first support system;

wherein the first modular skid, the first primary system and the first support system are removable as a whole from the main skid without removing the second modular skid, the second primary system or the second support system;

wherein the first primary system is an engine;

wherein the first support system is a first cooling system to provide cooling to the engine;

wherein the second primary system is a pump; and wherein the second support system is a lubrication system to provide lubrication to the pump.

12. The system of claim 11, wherein the engine is mechanically coupled to the pump.

13. The system of claim 11 further comprising:

a conveyor system coupled to the main skid and configured to move the first modular skid relative to the second modular skid.

14. The system of claim 13 wherein the conveyor system is at least one of a threaded conveyor system, a belt-driven conveyor system, a winch and pulley, or a hydraulically-operated cylinder.

15. A modular skid-based system to provide treatment or completion operations at a well, the system comprising:

a main skid configured to be positioned on a trailer or ground in proximity to the well;

a first modular skid positioned on the main skid, the first modular skid having a first primary system and a first support system;

a second modular skid positioned on the main skid, the second modular skid having a second primary system and a second support system, at least one of the second primary system and the second support system coupled to at least one of the first primary system and the first support system; and a conveyor system contained on or within and operably coupled to the main skid, the conveyor system configured to move the first modular skid relative to the second modular skid;

wherein the first modular skid, the first primary system and the first support system are removable as a whole from the main skid without removing the second modular skid, the second primary system or the second support system.

16. The system of claim 15, wherein the first primary system is an engine and the first support system is a first cooling system, the first cooling system providing cooling to the engine.

17. The system of claim 15, wherein the second primary system is a pump and the second support system is a second cooling system or a lubrication system to provide cooling or lubrication to the pump.

18. The system of claim 15, wherein:

the first primary system is an engine;

the first support system is a first cooling system to provide cooling to the engine;

the second primary system is a pump; and the second support system is a second cooling system or a lubrication system to provide cooling or lubrication to the pump.

19. The system of claim 18, wherein the engine is mechanically coupled to the pump.

20. The system of claim 15 wherein the conveyor system is at least one of a threaded conveyor system, a belt-driven conveyor system, a winch and pulley, or a hydraulically-operated cylinder.

21. The system of claim 15, wherein:

the first primary system is an engine;

the first support system is a first cooling system to provide cooling to the engine;

the second primary system is a mixer or blender; and the second support system is a second cooling system or a lubrication system to provide cooling or lubrication to the mixer or blender.

* * * * *